US005247920A

United States Patent [19]

Harbin

[11] Patent Number: 5,247,920

[45] Date of Patent: Sep. 28, 1993

[54] TOY BOW

[76] Inventor: John J. Harbin, 376 Brookdale Ave., Toronto, Ontario, Canada, M5M 1R2

[21] Appl. No.: 931,334

[22] Filed: Aug. 18, 1992

Related U.S. Application Data

[63] Continuation-in-part of Ser. No. 890,164, May 29, 1992, abandoned.

[51] Int. Cl.[5] ..... F41B 3/02

[52] U.S. Cl. ..... 124/20.1; 124/17; 124/44.6; 273/345

[58] Field of Search ..... 124/1, 16, 17, 20.1, 124/20.3, 23.1, 41.1, 44.6; 273/317, 318, 345-347, 424, 425

[56] References Cited

U.S. PATENT DOCUMENTS 2,477,531 7/1949 Volman ..... 273/345
2,645,490 7/1953 Volman ..... 124/44.6 X
4,166,618 9/1979 Sheem ..... 273/346 X
4,305,587 12/1981 O'Grady ..... 273/345
4,457,287 7/1984 Babington ..... 124/23.1

FOREIGN PATENT DOCUMENTS 2224665 5/1990 United Kingdom ..... 273/345

*Primary Examiner*—Randolph A. Reese
*Assistant Examiner*—John Ricci

[57] ABSTRACT

A toy bow has a frame with a central aperture for a captive arrow shank and a rearwardly facing central space. An elastomeric string extends between standards and the arrow shank is apertured to receive the bow string. The arrow head is of magnetic material for cooperation with a missile also of magnetic material, these members providing mutual magnetic force to hold the missile on the arrowhead until released by the arrow's deceleration after forward movement. Preferably parts of the bow interfere with the forward excursion of the bow string to decrease the forward excursion of the arrow.

15 Claims, 3 Drawing Sheets

TOY BOW

Figures 1, 9, 10:
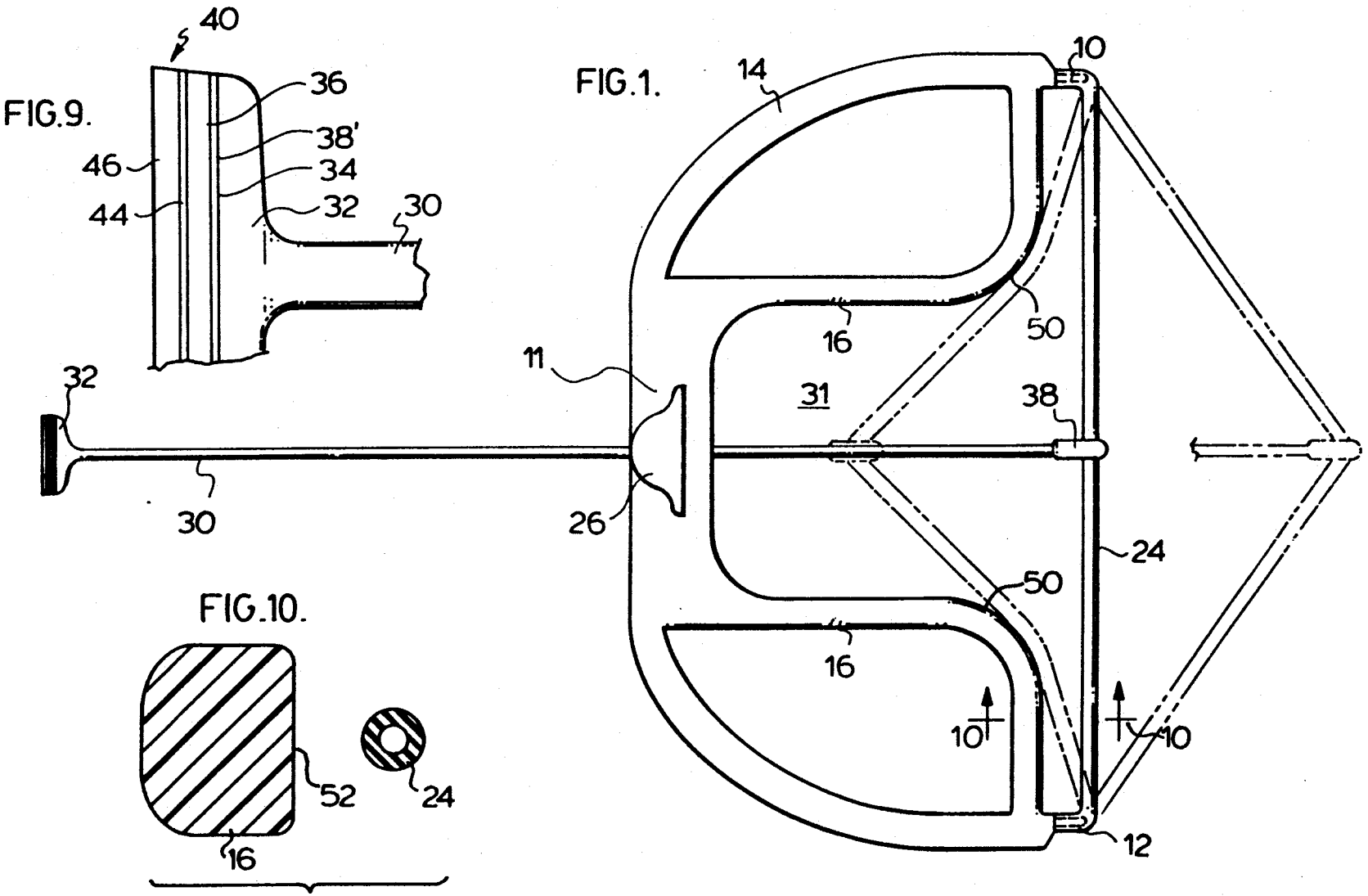

The application is a continuation-in-part of application Ser. No. 07/890,164 filed May 29, 1992, now abandoned.

This invention relates to a novel bow and a novel system using such bow.

There have been a number of toys wherein a bow with a captive arrow is used to project a missile toward a target. I have located the following patents. Through a search, I am aware of the following:

| | | |
|---|---|---|
| U.S. Pat. No. | 3,855,991 | 24 DEC 74 |
| U.S. Pat. No. | 4,166,618 | 04 SEP 79 |
| German Patent | 0531250 | AUG 31 |
| French Patent | 450,584 | 23 JAN 13 |
| Popular Science | | JUL 74 page 65 |

However all such bows have been flexible resulting (in the toy environment in which these bows are used) in complexity and expense of fabrication and in a larger size than is suitable for a toy.

It is an object of my invention to provide a bow and captive arrow toy, for launching a missile at a target, wherein the bow is rigid and the bow string is a strechable elastomer such as rubber or other elastomer. The rigid bow is simple and inexpensive to construct and may be a single piece of moulded plastic and is much simpler to provide than the flexible bow and inextensible string of a conventional bow.

Although magnetic missiles with magnetic targets have been used as shown in:

| | |
|---|---|
| U.S. Pat. No. | 3,176,989 |
| U.S. Pat. No. | 3,425,694 |
| U.S. Pat. No. | 4,305,587 |
| U.S. Pat. No. | 2,627,260 |
| U.S. Pat. No. | 647,327 |
| PCT Application | WO 85/00528 |

these have not been used with a bow and arrow in the art of which I am aware.

The following patents show a disk shaped magnetic missile having a central aperture:

| | |
|---|---|
| U.S. Pat. No. | 3,176,989 |
| PCT Application | WO 85/00528 |

Magnetic materials may, for the purposes of this application, be divided into hard and soft magnets. Hard magnets have a remanent flux so that they act as magnets in the absence of any exterior inducing magnetizing force. Soft magnets only act as such in the presence of an external magnetizing force (usually a hard magnet). Accordingly, magnetic material herein includes both hard and soft magnets. The preferred magnetic material for use herein has multiple north and south poles on one side only of a sheet. It will be noted that although this is a hard magnet, the effect of this magnetism is relatively weak on the opposite side of the sheet from the side with the poles. It is also noted that when two of such sheets have their pole sides juxtaposed, the sheets will first shift slightly relative to each other, if like poles are opposite, then will attract.

In accord with a preferred aspect of the invention there is provided a substantially rigid bow frame (preferably of moulded plastic) including upper and lower nipples or anchors, adapted to support a bow string extending vertically between them. The frame defines a rearwardly open space midway between said upper and lower standards to allow reciprocal movement of an arrow shank therein. A forward member joins said upper and lower nipples and defines an approximately centrally located aperture dimensioned and oriented to slidably receive an arrow shank. An elastomeric bow string joins said upper and lower standards. An arrow has a head and a shank and an aperture in the rear of said shank, through which the bow string passes. There is a forwardly facing surface on said head of magnetic material.

In a preferred aspect of the invention, the frame provides stops above and below the arrow which each extend downwardly from adjacent an anchor and curve forwardly to a location near the aperture, to provide above and below the arrow an interruption to bowstring forward travel, forward of its neutral position in the path from each post to the central aperture. The presence of this stop lengthens the bowstring path from the anchor to the central aperture but more importantly reduces the resilient extension of the elastomer over its entire length in its excursion forwardly of the elastomer's neutral position and prevents the string on the arrow fitting adjacent thereto striking the central portion of the bow and/or damaging the fitting. If it were not for this stop the bow would have to be made of much larger dimensions to avoid such striking and damage. The presence of these stops therefore contributes to the compactness of the bow construction. The stop may be provided by a different frame structure but the design outlined above is preferred.

The terms upward and downward in the specification and claims herein, and associated formatives, refer to the normal attitude in which a bow is held with the string vertical. The terms are not however used in a limiting sense and in fact the upper member may be the lower or the two members horizontally disposed relative to each other.

The terms forwardly and rearwardly herein respectively refer to the intended direction of missile flight from the bow and to the opposite direction.

In another aspect of the invention the bow as described above is combined with a missile of magnetic material which when propelled from the bow and its captive arrow is intended to attach to a target of magnetic material.

Thus the adherence of missile to arrow head and of missile to target may be achieved if the missile is of hard magnetic material and arrow head and target of soft. Conversely the missile might be of soft magnetic material and the arrow head and target of hard magnetic material. However the target is usually considerably larger than the other magnetic members making the latter construction more expensive.

In general however the magnetic interaction between missile and arrow head must be sufficient to retain the missile thereon. With a missile made from the poled one side magnetic sheet, the other side usually does not have sufficient magnetism to attach to the arrow head, so that it is also necessary to use the magnetic sheet also on the arrow head. In general therefore, the mutual magnets attraction between missile and arrow head must be sufficient to support the former thereon, until the arrow is released, while sufficiently limited to allow such release; and the mutual magnetism between the missile and the target must be sufficient that the missile will remain thereon after striking it in a desired orientation. By desired orientation is meant, with the correct side facing the target and approximately parallel thereto.

The preferred arrangement is to use a missile, a disk of hard magnetic material having on one side a relatively thin flat plastic cover layer. The magnet material on the arrow head is also flat and of hard magnetic material, while the target is of soft magnetic material. With this arrangement, the plastic covered side of the missile may be placed on the arrow head magnetic material. Thus the missile is held in place by the mutual magnetic attraction of the hard magnets in the missile and the arrow head acting through the plastic layer. The missile is on the one hand held in place until the arrow is released then leaves the head overcoming the weakened force. On the other hand the forward face of the missile, when released, is directed toward the target and will adhere strongly thereto.

In a preferred aspect of the invention the disk forming the missile is centrally apertured whereby the player may look through the aperture and determine with some accuracy the missile's location on the target.

The missile may however be of any size or shape which will magnetically attach to the arrow head and target and may be larger or smaller than the arrow head. Multiple missiles may be attached to the arrow head.

Figure 2:
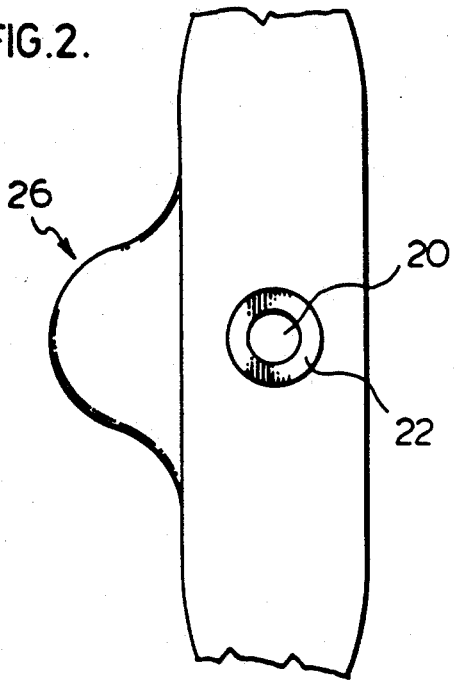
Figure 3:
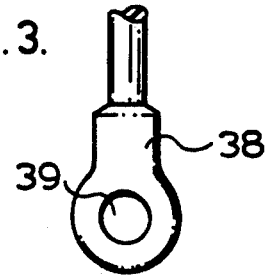
Figure 4:
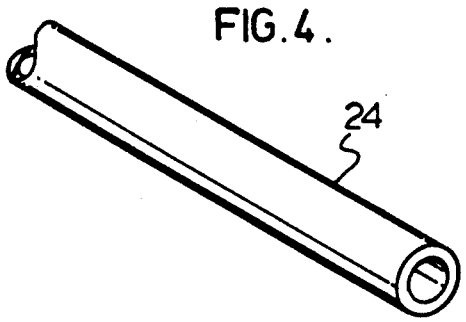
Figure 5:
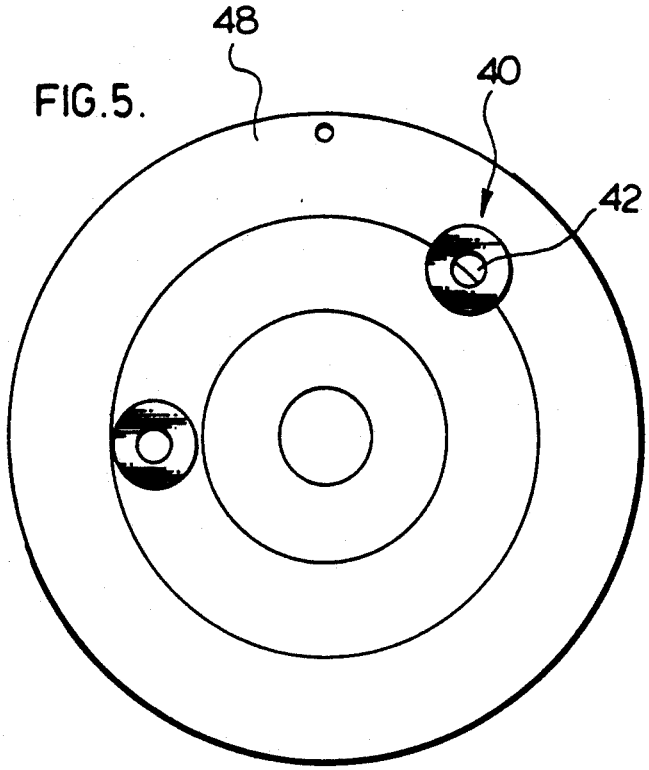
Figure 6:
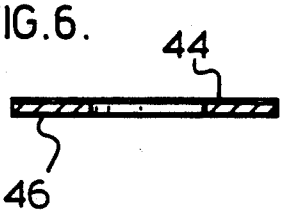
Figure 7:
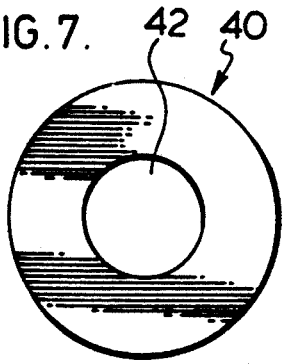
Figure 8:
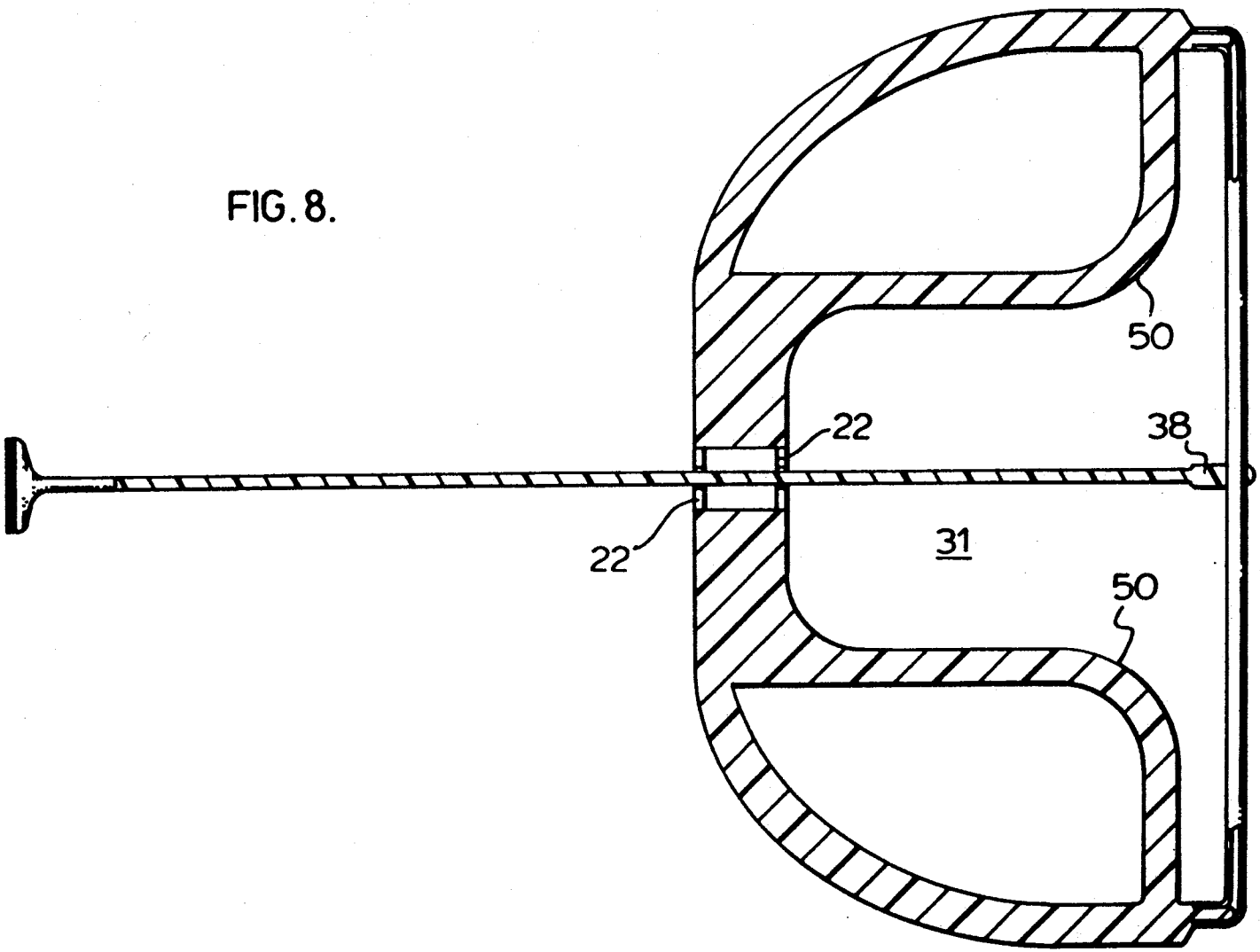

In drawings which show a preferred embodiment of the invention:

FIG. 1 is a side view of the inventive bow and arrow,

FIG. 2 is a view of a central extent of the bow looking forwardly, and with the arrow omitted, FIG. 3 is a view of the rearward portion of the arrow, looking in the direction for insertion of the bow string, FIG. 4 is a perspective view of the elastomeric bow string, FIG. 5 is a front view of the target, FIG. 6 is a sectional view of a missile, FIG. 7 is a front view of a missile, and FIG. 8 is a side view of the bow and arrow, partially in section, FIG. 9 is an enlarged view of the arrow head, FIG. 10 is a section along the lines 10—10 of FIG. 1.

In the drawings the substantially rigid frame, preferably of moulded plastic defines upper and lower anchors or nipples 10 and 12 and a central member 11 joining the upper standards. The central member may be joined to each of the upper and lower standards 10 by spaced arms 14 and 16 for rigidity. Midway along the central member it is apertured at 20 and oriented to allow forward and rearward sliding on an arrow shank 30. In the preferred embodiment shown the aperture 20 is made larger than the arrow shank requires and the aperture is provided for low friction, with forward and rearward nylon bushings 22 which are glued or otherwise attached to the aperture walls and which are centrally apertured to slidably receive the arrow shank. The bushings may of course be eliminated if the whole bow is made of nylon. The frame defines a space 31 rearward of aperture 20 into which the rearward extent of the arrow projects and may be grasped.

Elastomeric hose 24 is provided to stretchably fit over the upper and lower nipples 10 and 12. The hose may be held in place in any desired manner, with adhesive or binding. However it is found that this tubing will usually remain on the anchor by its friction only, if dimensioned to be distended when installed on the anchors. The hose should be taut in neutral position.

The bow, which is preferably cast as a one piece plastic member is preferably cast with a laterally projecting thumb piece 26 shaped to receive the thumb of the user on the hand holding the bow, while the other hand draws back the arrow and bow string. Preferably the bow, other than the thumb piece is made symmetrical about a median vertical plane so that the bow may be inverted when desired to accomodate a right or a left hand user.

The arrow comprises a one piece moulded shank 30 and head 32. The head is shaped to define a flat forwardly facing surface 34 having the peripheral contour of the missile.

When the bow string 24 is released, in the act of causing the arrow to propel a missile, the bow string tends to strike extents of the frame members 16 on each side of the elbows 50. To avoid consequent deflection of the bow string 24 possibly stinging the hands or arms of the user, and possible jamming of the arrow in its bearings the extents of the members 16 about and on each side of the elbow 50 are as shown in FIG. 10 shaped to form flat surfaces 52 facing the expected incidence direction of the bow string 24. Thus deflections of bow string 24 off flat surface 52 tend to remain close to the plane of symmetry of the bow. As stated in the introduction, stops are preferably placed on the frame, above and below the arrow position to act as stops to bow string travel of its neutral position, (which is the solid line attitude of FIG. 10 and to allow the bow to be made more compactly. In the preferred embodiment these stops are embodied by the outer surfaces of elbows 50, which contact the bow string in its travel forward of neutral position and prevent the rear arrow fitting from striking central extent 11 of the bow. A flat magnetic disk 36 having the peripheral contour of the missile is attached, preferably by adhesive 38' to surface 34. If the disk 36 has a stronger and a weaker magnetic side the stronger side will preferably face forward. (The disk 36 is usually circular but need not have the central aperture desireable on the missile). The arrow is provided with a tail piece 38 shaped to frictionally receive the rear end of the shank and exteriorly shaped to be grasped by the user's fingers. The tail piece is provided with an eye 39 to receive bow string 24. It is possible, if desired to provide positive attachment of the tail piece 38 to shank 30. However it is found in practice that a frictional connection of tail piece 38 to shank 30 is sufficient. If desired, the rearward end of the shank may be slightly enlarged, and the tail piece given a complementary shape so that the shank may be received in the tail piece with a snap action. Similiarly the anchors 10 and 12 may be made bulbous to assist the retention of elastomeric string 24 but this is not usually required.

The missile 40 is preferably an annular ring having a central aperture 42. The missile 40 preferably has a magnetized layer 46 and a plastic cover layer 44 on the side if there is one, of weaker magnetism.

The target 48 may be of any magnetic material and preferably is thin sheeting of iron or steel and may be painted with any target indicia desired, such as the bull's eye shown.

In construction the disk 36 is glued on the surface 34 of the arrow head. Then the shank with head attached is first threaded rearwardly through the frame aperture 20. Thereafter the tail piece 38 may first be assembled to the shank and the elastomer bow string 24 threaded through the shank eye 38. Alternatively the elastomer 24 could be threaded through the tail piece eye 39 before attachment of the shank to the tail piece. Thereafter the elastomer is attached to the upper and lower anchors 10 and 12.

To use the toy, the target is mounted to face the user. A missile 40 is attached to the magnetic arrow head. The missile's plastic coated side 44 is preferably attached to the magnetic surface of the arrow head. With the hard magnet materials used on both these members, the material magnetic forces through the plastic layer are sufficient to hold the missile on the arrow head but weak enough that the missile is easily released when the arrow is released by the fingers. The arrow will also release a missile with its magnetic side 46 facing the arrow head 32. However the magnetic retention of the missile will be greater and the speed of the released missile will be less.

In use then, with the missile 40 attached to the arrow head 32 the arrow is aimed at the target, the arrow shank is drawn back, extending the bow string 24 and released. The missile 40 leaves the arrow head and strikes the target, either flatly or obliquely and attaches thereto. The user's score or location or the target may then be read through aperture 42.

The magnetic material used for the missile and arrow head is preferably made from sheeting wherein the magnetic polarity is in the plane of the sheeting. (It is noted that if the magnetic polarization were transverse to the plane of the sheeting the missile could only be attached in one orientation to the head). For the magnetic sheeting I prefer to use that sold under the trade mark ULTRANAG by Flexmag Industrial Inc. of 4480 Lake Forest Drive Suite 304 Cincinati Ohio. For the elastomeric hose I prefer to use pure gum rubber.

Although I prefer that the arrow shank and head be one piece and the tail piece frictionally attached, it is possible to make the shank and tail piece as one piece and frictionally attach the head.

In the latter arrangement the shank is threaded forwardly through the frame aperture 20. Thereafter the head may be attached and the bow string threaded through the shank eye before attachment.

I claim:

1. Toy bow comprising:
a substantially rigid bow frame,
including upper and lower anchors,
adapted to support a bow string extending vertically between them,
said frame defining a rearwardly open space midway between upper and lower standards to allow reciprocal movement of an arrow shank therein,
a forward member joining said upper and lower standards with an approximately central aperture,
said aperture being dimensioned and oriented to slidably receive said arrow shank,
an elastomeric bow string joining said upper and lower standards,
an arrow having a head and a shank and an aperture in the rearward end of said shank,
said bow string passing through said aperture,
a forwardly facing surface on said head, of magnetic material,
wherein said frame provides stops above and below said arrow shank to provide an interruption to bow string forward travel forward of the bow string's neutral positions.

2. In combination with the toy bow of claim 1, a magnetic missile adapted to attach by magnetic force to said surface, said missile and said head surface having sufficient mutual magnetic attraction to cause such attachment and support of said missile on said head.

3. In combination with the toy bow and missile of claim 2 a target being a surface of magnetic material, at least-one of said missile and said target surface having sufficient mutual magnetic attraction to cause said attachment and support of said missile on said target.

4. Toy bow, missile and target as claimed in claim 3 wherein said missile is a disk.

5. Toy bow, missile and disk as claimed in claim 4 wherein said disk has a central aperture.

6. Toy bows, missile and target as claimed in claim 3 wherein said missile and said head are selected to each provide a component of the remanent magnetism causing support of said missile by said head.

7. Toy bow missile as claimed in claim 2 wherein said missile is a disk.

8. Toy bow, and missile as claimed in claim 7 wherein said disk has a central aperture.

9. Toy bow and missile as claimed in claim 7 wherein said missile and said head are selected to each provide a component of the remanent magnetism causing support of said missile by said head.

10. Toy bow and missile as claimed in claim 7 wherein said missile and said head are selected to each provide a component of the remanent magnetism causing support of said missile by said head.

11. Toy bow and missile as claimed in claim 2 wherein said missile and said head are selected to each provide a component of the remanent magnetism causing support of said missile by said head.

12. Toy bow, as claimed in claim 1 wherein said head magnetic material is selected and magnetized to provide sufficient remanent magnetism to support a missile thereon.

13. Toy bow comprising:
a substantially rigid bow frame,
including upper and lower anchors,
adapted to support a bow string extending vertically between them,
said frame defining a rearwardly open space midway between upper and lower standards to allow reciprocal movement of an arrow shank therein,
a forward member joining said upper and lower standards with an approximately central aperture,
said aperture being dimensioned and oriented to slidably receive said arrow shank,
an elastomeric bow string joining said upper and lower standards,
an arrow having a head and a shank and an aperture in the rearward end of said shank,
said bow string passing through said aperture,
a flat sheet on said head, of magnetic material, having a forwardly facing surface,
having magnetic polarity in the plane of the sheet.

14. Toy bow as claimed in claim 13 and a magnetic missile having a flat missile surface having magnetic polarity adapted to attach by magnetic force to said forwardly facing surface,
wherein the magnetic polarity of said flat missile surface is parallel to said missile surface,
said missile surface and said forwardly facing surface having sufficient mutual magnetic attraction to cause such attachment and support of said missile on said head.

15. In combination with the toy bow and missile of claim 14 a target being a surface of magnetic material, at least one of said missile and said target surface having sufficient mutual magnetic attraction to support said missile on said target.

* * * * *